United States Patent [19]

Sundermann et al.

[11] Patent Number: 4,775,848

[45] Date of Patent: Oct. 4, 1988

[54] HIGH-VOLTAGE VALVE REACTOR, SPECIFICALLY FOR HIGH-VOLTAGE DIRECT-CURRENT TRANSMISSION SYSTEMS

[75] Inventors: Reinhold Sundermann, Stuhr; Paul Kukert, Bremen; Tibor Salanki, Erlangen, all of Fed. Rep. of Germany

[73] Assignee: Siemens Aktiengesellschaft, Berlin and Munich, Fed. Rep. of Germany

[21] Appl. No.: 913,812

[22] Filed: Sep. 30, 1986

[30] Foreign Application Priority Data

Oct. 1, 1985 [DE] Fed. Rep. of Germany ..... 3535018

[51] Int. Cl.[4] ..... H01F 27/08; H01F 27/30

[52] U.S. Cl. ..... 336/62; 336/92; 336/96; 336/197

[58] Field of Search ..... 336/62, 92, 96, 67, 336/68, 205, 197, 210

[56] References Cited

U.S. PATENT DOCUMENTS

| | | | |
|---|---|---|---|
| 1,471,096 | 10/1923 | Brand | 336/62 |
| 1,789,229 | 1/1931 | Gebhand | 336/62 |
| 2,264,057 | 11/1941 | Treanor . | |
| 2,413,195 | 12/1946 | Schwager | 336/92 |
| 2,464,029 | 3/1949 | Ehrman | 336/96 X |
| 2,579,522 | 12/1951 | Strickland . | |
| 2,699,531 | 1/1955 | Massar | 336/92 |
| 2,988,715 | 6/1961 | Gizynski et al. | 336/96 |
| 3,258,728 | 6/1966 | Wiley et al. | 336/96 X |
| 3,562,684 | 2/1971 | Sole | 336/62 X |
| 3,728,655 | 4/1973 | Reinke | 336/62 |
| 4,055,825 | 10/1977 | Kleen et al. | 336/92 X |
| 4,083,026 | 4/1978 | Kleen et al. | 336/92 X |
| 4,459,575 | 7/1984 | Geissler et al. | 336/92 X |

FOREIGN PATENT DOCUMENTS

| | | | |
|---|---|---|---|
| 0050432 | 4/1982 | European Pat. Off. . | |
| 7033940 | 5/1972 | France . | |
| 2363874 | 9/1976 | France | 336/62 |
| 1137148 | 9/1962 | Fed. Rep. of Germany . | |
| 2607883 | 2/1976 | Fed. Rep. of Germany | 336/62 |
| 2554142 | 6/1977 | Fed. Rep. of Germany . | |
| 2642111 | 3/1978 | Fed. Rep. of Germany . | |
| 3404457 | 8/1985 | Fed. Rep. of Germany . | |
| 630353 | 10/1949 | United Kingdom . | |

*Primary Examiner*—Thomas J. Kozma
*Attorney, Agent, or Firm*—James G. Morrow

[57] ABSTRACT

A compact valve choke that is simple to manufacture, which can, however, ensure the qualities required for all operating modes, namely the needed dielectric strength and freedom from partial discharges between components that are at different voltages. This valve-choke is achieved by having: the choke windings arranged in a supporting frame in a self-supporting manner, in relation to one leg of the choke core; the choke windings potted on all sides, and the potted block supported in the supporting frame by means of fittings; the choke core consists of two generally circular-shaped cores and is secured in the supporting frame; and the choke coil includes two primary windings wound in two layers, with an outer first winding portion and a concentric inner second winding portion as well as, a core-potential center tap roughly in the center of the windings between the first winding portion and the second winding portion.

10 Claims, 2 Drawing Sheets

HIGH-VOLTAGE VALVE REACTOR, SPECIFICALLY FOR HIGH-VOLTAGE DIRECT-CURRENT TRANSMISSION SYSTEMS

BACKGROUND OF THE INVENTION

This invention relates to a valve reactor for high-voltage direct-current (HVDC) transmission systems.

HVDC transmission systems are currently in general use in the distribution of electrical energy, as the connecting elements between two three-phase alternating-current power networks. Line-actuated controlled semiconductors, such as thyristors, convert the three-phase current to HVDC for transmission at the transmitting end and back into three-phase current at the receiving end. The highest attainable thyristor operating voltage is small in comparison with the valve voltage required for economical transmission. For this reason, a HVDC transmission valve must be made up of a number of thyristors connected in series. In order to limit the rate of current rise in a distributed manner, each of the individual thyristors in a HVDC transmission valve must additionally be connected in series with a valve reactor or choke having a choke winding and a liquid-cooled choke core.

SUMMARY OF THE INVENTION

It is an object of this invention to provide a valve-choke that can be economically to manufacture since there will be many used to construct each HVDC valve.

It is another object of this invention to provide a valve-choke for a standard thyristor-and-choke-module which can be assembled in valve stacks containing sufficient modules to withstand the forward and reverse potentials. It is desired to have a very short time for replacement of the module with the choke in order to keep power outages from thyristor failure to a minimum.

Briefly stated, in accordance with one aspect of the invention, the aforementioned objects are achieved by providing a valve choke for use in HVDC transmission systems including a supporting frame; a choke core, consisting of two U-shaped cores, fastened in the supporting frame; and a choke coil arranged in the supporting frame in a self-supporting manner with a clearance on all sides relative to a leg of the choke core, which choke coil is potted on all sides forming a potted block and the potted block is supported in the supporting frame by means of fittings.

In accordance with the invention, a compact value choke is simply manufactured which nonetheless ensures the required characteristics, such as dielectric strength and no electrical discharges between components at different potentials, at any operating condition.

In a further aspect of the invention, the objects of the invention are achieved by having the supporting frame, which serves on the one hand for the mounting of the choke core and on the other for the attachment of the choke coil in a self-supporting manner in relation to said choke core, consists of plastic; thus, in addition to a simple specific molding procedure for the mounting fittings, the valve choke can be made more compact by virtue of the fact that the supplementary losses due to stray fields can be reduced.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF THE PREFERRED EMBODIMENT

The entire choke coil winding is in a potted block, which is attached with mounting supports to a frame in a self-supporting manner, said choke coil winding being thereby arranged in a contact-free manner in relation to only one leg of the choke core, which is itself not potted; thus, while the construction is compact and easy to install, it allows a high insulating strength as well as maximal surface-leakage path lengths and thus provides good freedom from partial discharges as well as very good cooling qualities.

The choke coil, which engages only one leg of the choke core, can be made particularly compact, and specifically with a small component height, by virtue of the fact that the said choke coil is made in two layers, having a first winding portion and a second winding portion concentric thereto, and having a core-potential center connection roughly in the center of the winding, that is, at the transition from the first winding portion to the second winding portion; in said manner, the voltage load between the choke core and the choke coil, which is mounted in a self-supporting manner in relation to the one leg of the choke core, can be reduced to half the rated voltage, so that the maximally required air gap lengths or surface-leakage path lengths are likewise diminished by half. Also contributing to the compactness of the valve choke in accordance with the invention is the especially good heat-dissipation capability, which is due in particular to the fact that the cooling tube, through which coolant flows, is potted to the surrounding primary winding while, on the other hand, the choke core is not potted; in this way, furthermore, accumulations of material and thus the danger of increased material stresses due to differing coefficients of thermal expansion can be advantageously avoided in comparison with valve chokes having the choke coil and choke core potted together.

Figure 1:
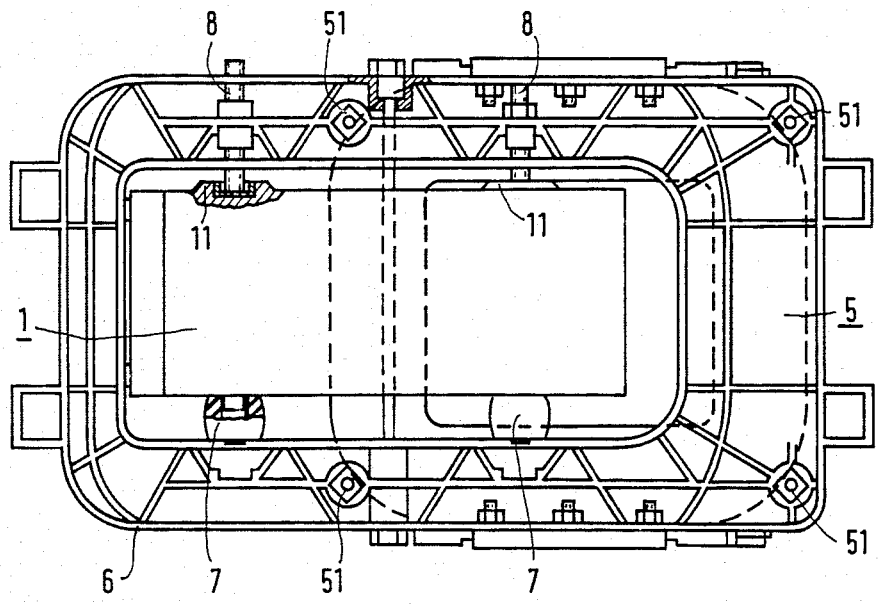
FIG. 1 shows a side view of a valve choke.
Figure 2:
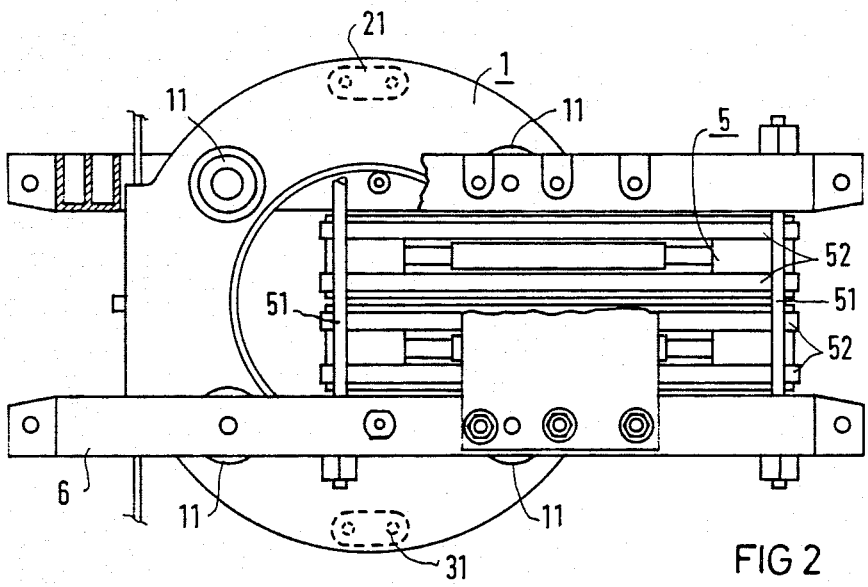
FIG. 2 shows a plan view of the valve choke of FIG. 1, with the supporting frame partly cut away for clarity.

FIG. 1 shows ribbed plastic supporting frame 6 there are mounted, as the most important parts of the valve choke, a tape-wound choke core 5 as well as a potted block 1, into which potted block a primary winding 2, 3 and a secondary winding 4 are incorporated. The double-U-shaped tape-wound choke core 5, held together by tension bands 52 as shown in FIG. 2, is mounted in the supporting frame 6 by means of tie rods 51. The left leg of the tape-wound choke core 5 is surrounded in a contact-free manner by the potted block 1, in which the primary winding 2, 3 and the secondary winding 4 are incorporated. The potted block 1 is supported by fittings in the supporting frame 6 in such a manner that it is self-supporting in relation to the left leg of the tape-wound choke core 5. The bottom fittings are rubber buffers 7, while for the top fittings funnel-shaped indentations 11 are cast into the potted block 1, into which indentations the threaded pins 8 reach, the depth of penetration of the said threaded pins with respect to the supporting frame 6 being adjustable and fixable after the desired depth of penetration has been achieved.

Figure 4:
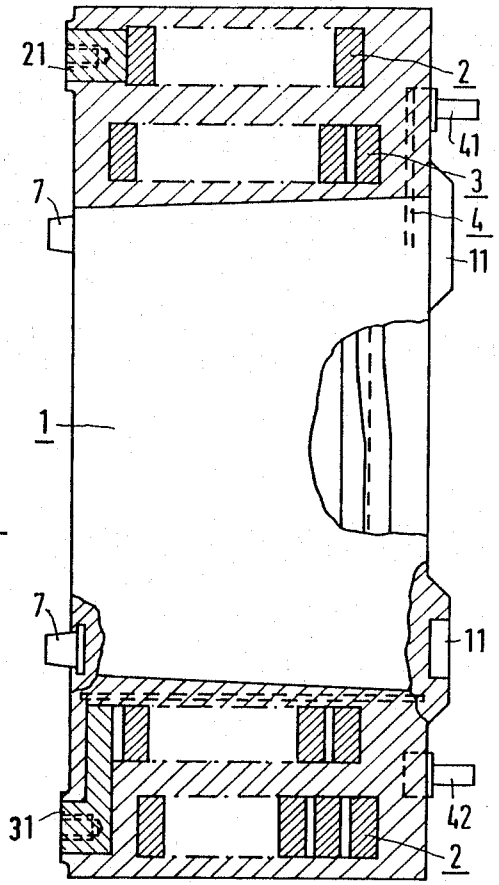
FIG. 4 shows the partly cutaway side view of the arrangement of FIG. 3.
Figure 3:
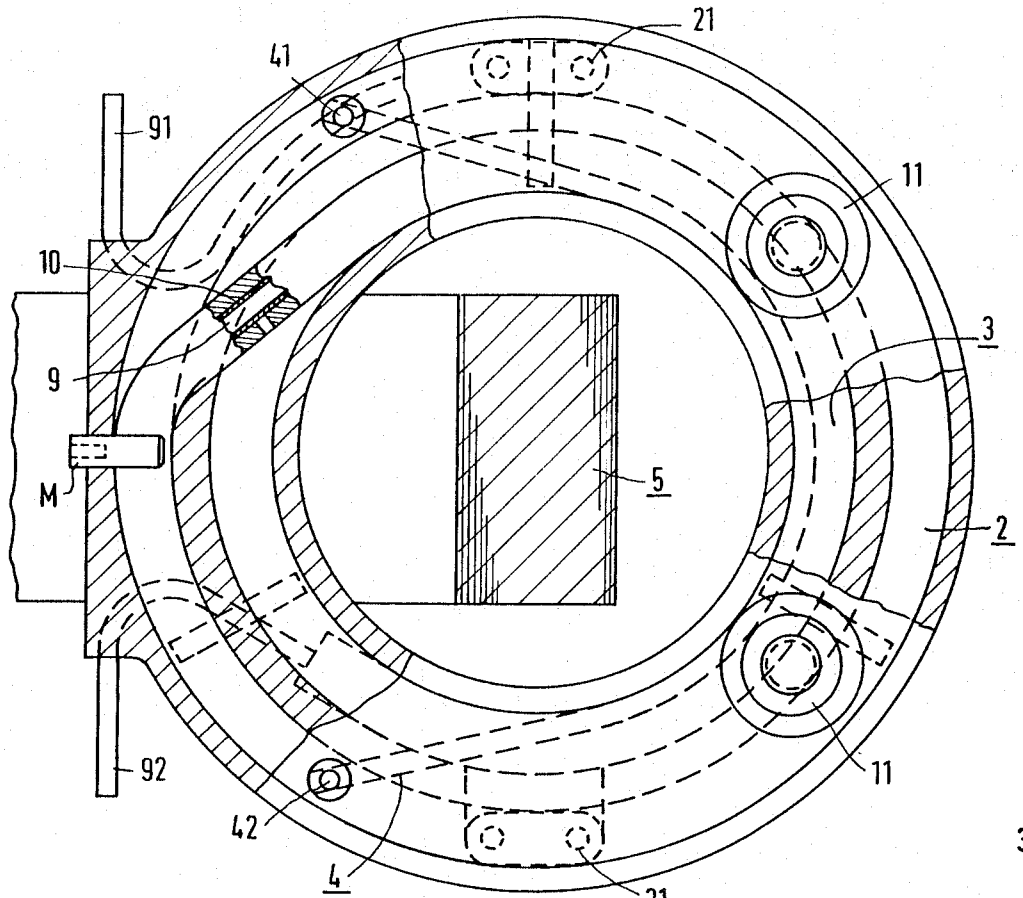
FIG. 3 shows a partly cutaway front plan view of the potted block, encircling the one leg of the choke core with a clearance on all sides and containing the primary winding and the secondary winding as well as the cooling tubes of the primary and secondary windings.

As can be seen specifically from FIGS. 3 and 4, the primary windings 2, 3 of the choke coil are wound in two layers, with a first winding portion 2 having an external connection 21 and a second, inner winding portion 3 concentric thereto having an external connection 31, and with a core-potential center connection M in the center of the windings, that is, in the region of the transition from the outer, first winding portion 2 to the inner, second winding portion 3. A single-layered secondary winding 4 has its external connections 41, 42 protruding out of the potted block 1. The primary windings 2, 3 are cooled by a stainless steel cooling tube 9 having the external connections 91, 92, through which cooling tube water flows; in order to improve the thermal contact between the cooling tube 9 and the surrounding secondary windings 2, 3, which desirably take the form of an edgewise-wound, copper, hollow-cross-section conductors, the intermediate space between the cooling tube 9 and the primary windings are likewise filled with a potting compound 10, as can be seen from the cutaway in the left-hand portion of FIG. 2. In place of the potting of the cooling tube inside the primary windings, which are preferably made as a hollow cross-section with the cooling tube running inside the hollow cross-section, as provided here, the cooling tube can be pressure-expanded or the hollow cross-section can be shrunk onto the cooling tube in order to ensure that the said cooling tube is in particularly good thermal contact with the primary winding.

As can be seen from FIG. 2, the leg of the tape-wound choke core 5 that is enclosed by the potted block 1 is held in a contact-free manner in relation to the said potted block 1, with a clearance or vacancy on all sides, so that in comparison with otherwise usual windings keyed on the choke core, there is a substantially higher factor of safety against partial discharges for equal dimensions or, if the protection against partial discharges remains equally good, the choke module can be made substantially more compact.

It will now be understood that there has been disclosed an improved valve-choke for HVDC transmission system valve assemblies. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A valve choke for use in HVDC transmission systems comprising:

a supporting frame including at least one generally rectangular member defining an opening;

a choke core including a first U-shaped core and a second U-shaped core, the choke core being fastened to the supporting frame;

a choke coil arranged adjacent to the choke core defining a center opening having an opening wall, the choke coil being circumscribed and supported by the rectangular member such that a portion of the first U-shaped core is located within the center opening while not contacting the opening wall, wherein the opening wall and the first U-shaped core define a vacancy, the vacancy forming a dielectric isolation between the choke core and choke coil; and the choke coil is potted on all sides forming a potted block and the potted block is supported by the supporting frame by means of a plurality of fittings.

2. A valve choke in accordance with claim 1, wherein the choke core is not potted along with choke coil.

3. A valve choke in accordance with claim 1, wherein the choke coil contains primary windings wound in two layers, having a first winding portion and a second winding portion concentric thereto, as well as a core-potential center connection substantially in the center of the windings between the first winding portion and the second winding portion.

4. A valve choke in accordance with claim 1, wherein the primary windings comprises a copper, hollow-cross-section conductor.

5. A valve choke in accordance with claim 4, wherein the copper, hollow-cross-section conductor is wound edgewise.

6. A valve choke in accordance with claim 1, wherein each of the primary windings has a cooling tube through which a coolant flows in intimate thermal contact.

7. A valve choke in accordance with claim 6, wherein good conductive thermal contact between the cooling tube and each of the surrounding primary windings is achieved by means of a potting compound lying between them.

8. A valve choke in accordance with claim 6, wherein a copper, hollow-cross-section conductor having a pressure expanded cooling tube running inside the hollow profile is employed, the cooling tube providing good conductive thermal contact between the cooling tube and the surrounding primary winding.

9. A valve choke in accordance with claim 1, further comprising: the potted block has embedded along with the primary windings, a secondary winding, which is connectable to a secondary resistance for the purpose of providing an adjustable electromagnetic damping.

10. A valve choke in accordance with claim 1, wherein the supporting frame and further mounting means between the supporting frame and the components contained therein are further comprised of plastic.

* * * * *